US007015425B2

(12) United States Patent
Neal et al.

(10) Patent No.: US 7,015,425 B2
(45) Date of Patent: Mar. 21, 2006

(54) GAS CYLINDER WARMER WITH VARIABLE WATTAGE SELF REGULATING HEATER

(75) Inventors: Michael J. Neal, Hilliard, OH (US); Doug Dietz, Dublin, OH (US); Daniel R. Smith, Farmington Hills, MI (US)

(73) Assignee: B H Thermal Corporation, Columbus, OH (US)

( * ) Notice: Subject to any disclaimer, the term of this patent is extended or adjusted under 35 U.S.C. 154(b) by 0 days.

(21) Appl. No.: 10/828,836

(22) Filed: Apr. 21, 2004
(Under 37 CFR 1.47)

(65) Prior Publication Data

US 2005/0109758 A1 May 26, 2005

Related U.S. Application Data

(60) Provisional application No. 60/464,833, filed on Apr. 22, 2003.

(51) Int. Cl.
*H05B 3/36* (2006.01)

(52) U.S. Cl. ..... 219/386; 219/521; 219/529; 219/535; 219/539

(58) Field of Classification Search ..... 219/385, 219/386, 521, 528, 529, 535, 537, 539, 549; 392/441, 444; 222/146.5
See application file for complete search history.

(56) References Cited

U.S. PATENT DOCUMENTS 4,743,321 A * 5/1988 Soni et al. ..... 156/85
4,833,299 A * 5/1989 Estes ..... 392/444
4,905,855 A * 3/1990 Troiano et al. ..... 220/581
4,912,303 A * 3/1990 Beavers et al. ..... 219/535
5,197,595 A * 3/1993 Coultas ..... 206/0.6
5,377,495 A 1/1995 Daigle
5,632,919 A * 5/1997 MacCracken et al. ..... 219/494
5,714,738 A * 2/1998 Hauschulz et al. ..... 219/535
5,827,050 A * 10/1998 Price ..... 417/207
5,931,342 A * 8/1999 Taylor ..... 222/5
5,974,820 A * 11/1999 Boyd ..... 62/292
5,986,240 A * 11/1999 Schmitt et al. ..... 219/391
6,025,576 A * 2/2000 Beck et al. ..... 219/521
6,300,597 B1 * 10/2001 Lee ..... 219/529

* cited by examiner

*Primary Examiner*—Joseph Pelham
(74) *Attorney, Agent, or Firm*—Porter, Wright, Morris & Arthur, LLP

(57) ABSTRACT

A gas cylinder includes a cylindrically-shaped main wall having a liner, a facing and insulation located between the liner and the facing. First and second electric, self-regulating heating elements are positioned between the liner and the insulation. The liner is provided with first and second pockets and the first and second heating elements are located within the pockets. The first heating element has a higher wattage density than the second heating element and the first heating element is located below the second heating element. A sealed conduit enclosure contains a terminal block connecting a power input cable to the first and second heating elements. A planar top wall is located at the top of the main wall and has an opening for passage of a regulator of the gas cylinder.

18 Claims, 4 Drawing Sheets

GAS CYLINDER WARMER WITH VARIABLE WATTAGE SELF REGULATING HEATER

CROSS-REFERENCE TO RELATED APPLICATIONS

This patent application claims the priority benefit of provisional patent application No. 60/464,833 filed on Apr. 22, 2003, the disclosure of which is expressly incorporated herein in its entirety by reference.

STATEMENT REGARDING FEDERALLY SPONSORED RESEARCH

Not Applicable

REFERENCE TO MICROFICHE APPENDIX

Not Applicable

FIELD OF THE INVENTION

The present invention generally relates to an electrical resistance heating apparatus and, more particularly, to a gas cylinder warmer or the like.

BACKGROUND OF THE INVENTION

In many industries, it is advantageous to heat objects in a desired manner. Often, a flexible heater such as a heating pad, jacket, or jacket is disposed on or about the surface of the object to be heated so that, when activated, the flexible heater elevates the temperature of the object. For an example of such a flexible heater, see U.S. Pat. No. 5,883,364 the disclosure of which is expressly incorporated herein in its entirety by reference.

One application of such flexible heaters is gas cylinders warmers which are used in industries such as, for example, welding, compressed/specialty gas manufacturers, pharmaceutical manufacturers, and semiconductor manufacturers. Heating a gas cylinder creates convection currents to increase pressure inside the cylinder which improves process control (maintains the gas at a desired temperature and pressure) and condensation control (reduces the amount of gas that is condensed within the cylinder and thus wasted). Condensation control is important because using all of the gas in the cylinder reduces wasted gas and saves money. The most common gas that benefits from gas cylinder warmers is $SF_6$ (Sulfur Hexafluoride). However, there are many other gases which can benefit from the use of gas cylinder warmers such as, for example, propane, nitrogen, oxygen, $BCl_3$, $WF_6$, and HF.

While these prior gas cylinder warmers generally perform their intended purpose, they do not always provide a uniform temperature across the gas cylinders when operated in a wide range of ambient temperatures. The prior gas cylinder warmers typically result in temperature profiles having severe hot spots. Uniform heat is ideal for process temperature maintenance and also for gas bake-out (condensation control). Additionally, these gas cylinder warmers typically require the use of a temperature controller. The use of a temperature controller adds cost and complexity to the system and thus it is desirable to avoid use of a temperature controller if possible. Furthermore, these gas cylinder warmers typically cannot be used for in outdoor and or hazardous locations (Class I, Division I, and Group C &D). Accordingly, there is a need in the art for improved gas cylinder warmers.

SUMMARY OF THE INVENTION

The present invention provides a gas cylinder warmer which overcomes at least some of the above-noted problems. In accordance with one aspect of the present invention, a gas cylinder warmer comprises, in combination, first and second layers and a plurality of electric, self-regulating heating elements positioned between the first and second layers. A first one of the heating elements produces a higher temperature than a second one of the heating elements.

According to another aspect of the present invention, a gas cylinder warmer comprises, in combination, a cylindrically-shaped main wall including a liner, a facing and insulation located between the liner and the facing. At least one electric, self-regulating heating element is positioned between the liner and the insulation. A planar top wall located at the top of the main wall and having an opening for passage of a gas cylinder regulator.

According to yet another aspect of the present invention, a gas cylinder warmer comprises, in combination, a cylindrically-shaped main wall including a liner, a facing, and insulation located between the liner and the facing. First and second electric, self-regulating heating elements positioned between the liner and the insulation. The liner is provided with first and second pockets and the first and second heating elements are located within the pockets. The first heating element has a higher wattage density than the second heating element. The first heating element is located below the second heating element. A gas-tight enclosure contains an electrical connection between a power input cable and the first and second heating elements. A planar top wall is located at the top of the main wall and has an opening for passage of a regulator for the gas cylinder.

From the foregoing disclosure and the following more detailed description of various preferred embodiments it will be apparent to those skilled in the art that the present invention provides a significant advance in the technology and art of gas cylinder warmers. Particularly significant in this regard is the potential the invention affords for providing a high quality, reliable, low cost assembly which obtains a substantially uniform temperature over the gas cylinder. Additional features and advantages of various preferred embodiments will be better understood in view of the detailed description provided below.

BRIEF DESCRIPTION OF THE DRAWINGS

These and further features of the present invention will be apparent with reference to the following description and drawings, wherein.

Figure 2:
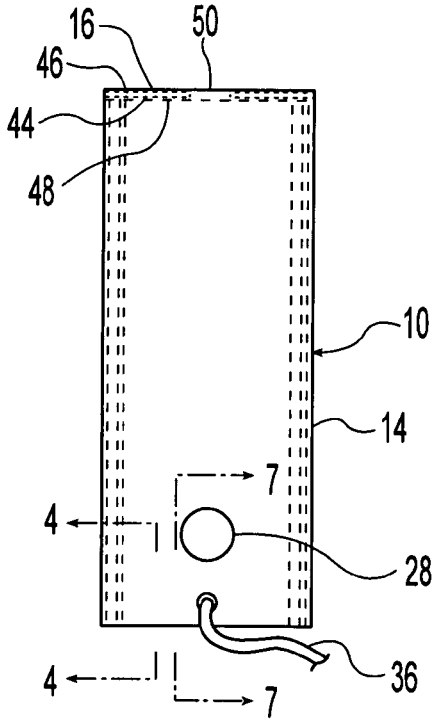
FIG. 2 is an elevational view of the gas cylinder warmer of FIG. 1.

It should be understood that the appended drawings are not necessarily to scale, presenting a somewhat simplified representation of various preferred features illustrative of the basic principles of the invention. The specific design features of the gas cylinder warmer as disclosed herein, including, for example, specific dimensions, orientations, and shapes of the flexible heater layers and the flexible heating element will be determined in part by the particular intended application and use environment. Certain features of the illustrated embodiments have been enlarged or distorted relative to others to facilitate visualization and clear understanding. In particular, thin features may be thickened, for example, for clarity or illustration. All references to direction and position, unless otherwise indicated, refer to the orientation of the flexible heater assembly illustrated in the drawings. In general, up or upward refers to an upward direction within the plane of the paper in FIG. 2, and down or downward refers to a downward direction within the plane of the paper in FIG. 2. Also in general, vertical refers to an upward/downward direction within the plane of the paper in FIG. 2 and horizontal refers to a left/right direction within the plane of the paper in FIG. 2.

DETAILED DESCRIPTION OF CERTAIN PREFERRED EMBODIMENTS

It will be apparent to those skilled in the art, that is, to those who have knowledge or experience in this area of technology, that many uses and design variations are possible for the improved gas cylinder warmer disclosed herein. The following detailed discussion of various alternative and preferred embodiments will illustrate the general principles of the invention with reference to a gas cylinder warmer for use with a standard gas cylinder. Other embodiments suitable for other applications will be apparent to those skilled in the art given the benefit of this disclosure.

Figure 1:
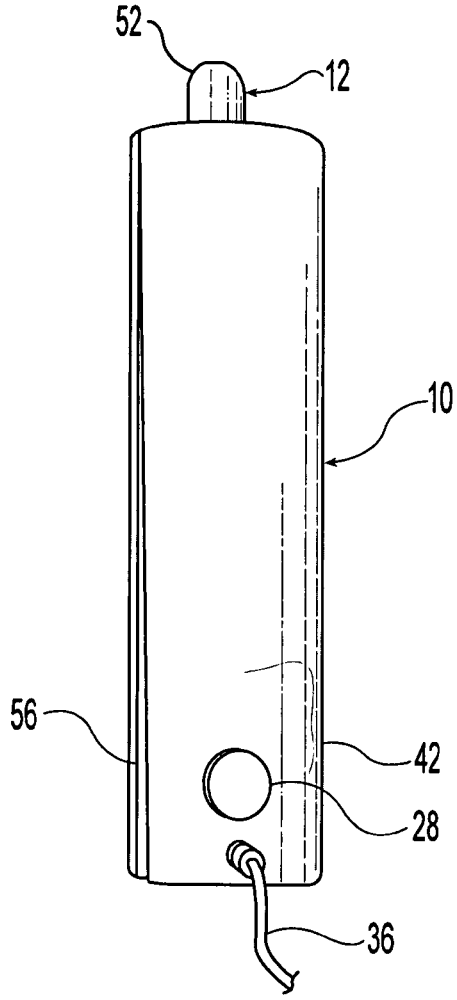
FIG. 1 is a perspective view of a gas cylinder with a gas cylinder warmer according to the present invention secured to the exterior thereof.
Figure 7:
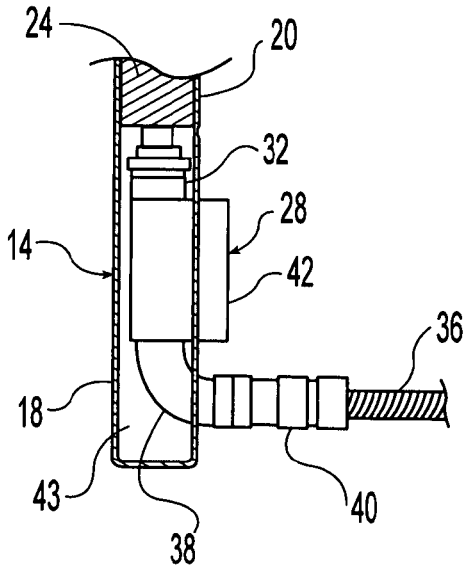
FIG. 7 is a cross-sectional view taken along line 7—7 of FIG. 2.
Figure 4:
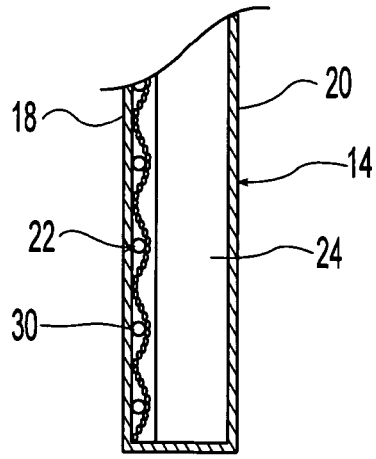
FIG. 4 is a cross-sectional view taken along line 4—4 of FIG. 2.
Figure 3:
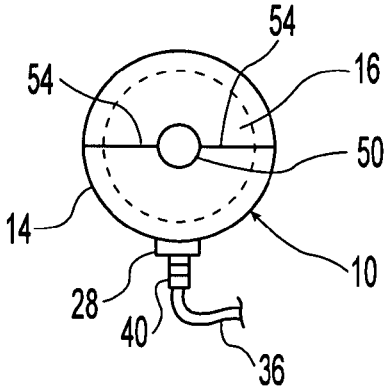
FIG. 3 is a top plan view of the gas cylinder warmer of FIGS. 1 and 2.

Referring now to the drawings, FIG. 1 illustrates a gas cylinder warmer 10 according to the present invention which is disposed on the exterior surface of a gas cylinder 12. As best shown in FIGS. 2 to 7, the illustrated gas cylinder warmer 10 includes a cylindrical-shaped main wall 14 sized and shaped to extend about the periphery of the gas cylinder 12 and a planar, round-shaped top wall 16 sized and shaped to generally close the top opening of the cylindrically-shaped main wall 14. The illustrated main wall 14 includes a flexible first or inner layer or liner 18, a flexible second or outer layer or facing 20, at least one flexible heating element 22 located between the liner 18 and the facing 20, and insulation 24 located between the heating element 22 and the facing 20.

Figure 5:
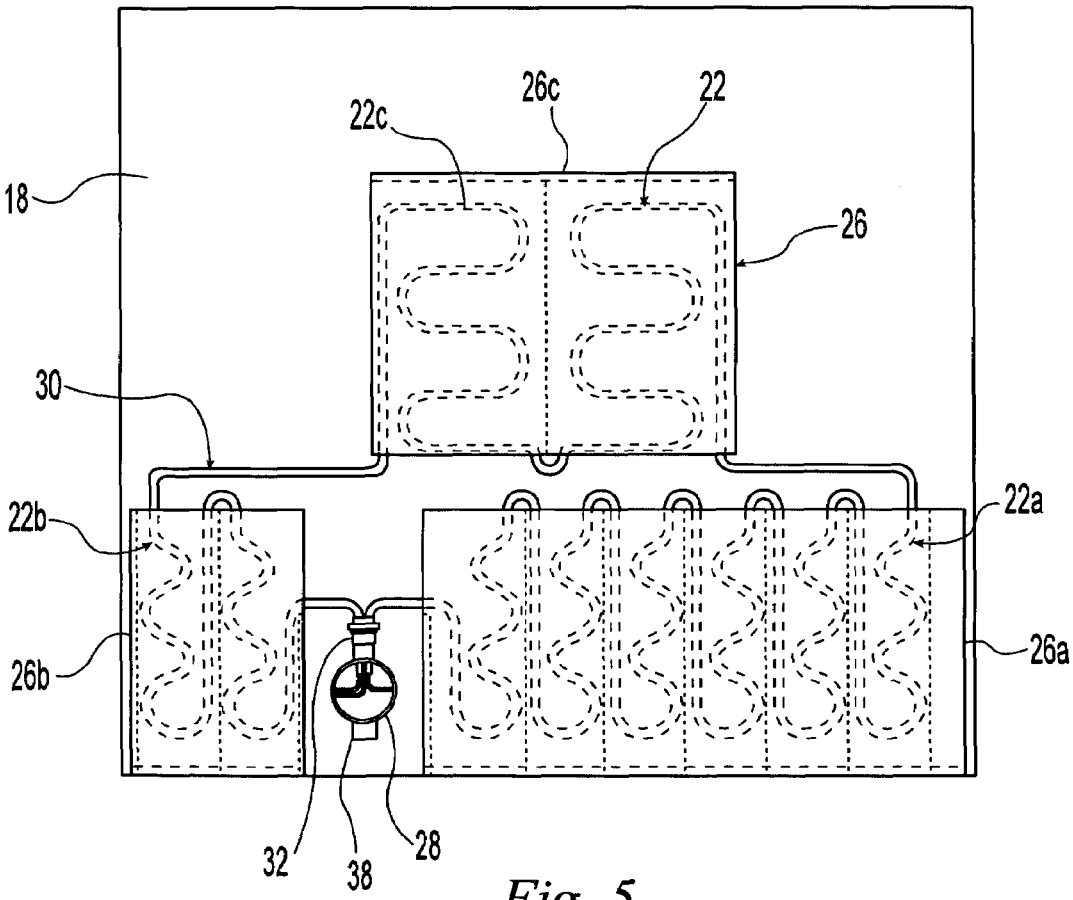
FIG. 5 is an enlarged elevational view of outer side of an inner layer of the gas cylinder warmer of FIGS. 1 to 4 during assembly.

The illustrated liner 18 is formed by a rectangular-shaped sheet of generally flexible material (best shown in FIG. 5). Formed on the outer surface of the illustrated liner 18 is a plurality of pockets 26 sized and shaped for holding the heating elements 22. The illustrated pockets 26 are further partitioned into sections for positioning and holding the heating elements 22 in a desired manner. The illustrated pockets 26 are formed by rectangular-shaped sheets of generally flexible material which are secured to the liner 18. The illustrated pockets 26 are sewn to the liner 18 and sewn to form the partitions but other suitable methods of securing the pockets 26 and/or forming the partitions can alternatively be utilized. The illustrated liner 18 is provided with first and second lower pockets 26*a*, 26*b* adjacent the lower edge of the liner 18 and an upper pocket 26*c* located above the lower pockets 26*a*, 26*b*. It is noted that alternatively a greater or lesser number of lower and/or upper pockets 26 can be utilized. The illustrated first and second lower pockets 26*a*, 26*b* are spaced apart a distance adequate for locating a sealed gas-tight enclosure for electrical connections such as, for example, the illustrated conduit enclosure 28 as described in more detail hereinbelow.

The illustrated gas cylinder warmer 10 includes first and second lower heating elements 22*a*, 22*b* and an upper heating element 22*c* which are the heating sources for the gas cylinder warmer 10. It is noted that alternatively the gas cylinder warmer 10 can utilize a greater or lesser number of lower and/or upper heating elements 22. The first and second lower heating elements 22*a*, 22*b* are collectively sized and positioned to heat a bottom portion of the gas cylinder 12 while the upper heating element 22*c* is sized and positioned to heat an upper portion of the gas cylinder 12.

The illustrated heating elements are formed by a self-regulating heating cable 30. The heating cable 30 preferably includes a fluoropolymer outer jacket. A suitable self-regulating heating cable 30 is available from Rockbestos-Surprenant Cable Corporation of Clinton, Mass. It is noted that the heating elements 22 can alternatively be of any other suitable type, such as for example, tape, foil, or the like. The illustrated heating cable 30 has a first end extending from the conduit enclosure 28 to the first lower pocket 26*a* within which it is disposed in a serpent-like manner to form the first lower heating element 22*a*. The heating cable 30 extends from the first lower pocket 26*a* to the upper pocket 26*b* within which it is disposed in a serpent-like manner to form the upper heating element 22*c*. The heating cable 30 then extends from the upper pocket 26*c* to the second lower pocket 26*c* within which it is disposed in a serpent-like manner to form the second lower heating element 22*c*. A second end of the heating cable extends from the second lower pocket 26*c* to the conduit enclosure 28. The illustrated heating elements 22 are each generally rectangular-shaped but it is noted that any other suitable shape can be alternatively utilized such as, for example, oval, circular, square or other suitable geometric shape. The illustrated heating elements 22 are secured to the liner by the pockets 26 but can alternatively be secured in any suitable manner such as, for example, embedding, bonding, clamping, or stitching so that the heating elements 22 remain flexible enough generally conforms to the shape of the gas cylinder 12. Seams are sewn into the pockets 26 to hold and secure the heating cable 30 in its desired shape and position. Formed in this manner, the illustrated heating elements 22 are located so that they each directly contact the liner 18 which directly contacts the gas cylinder 12 so that preferably only the liner 18 separates the heating elements 22 from exterior surface of the gas cylinder 12, that is, the surface to be heated when the liner 18 is placed directly on the gas cylinder 12.

The heating elements 22 are preferably sized and positioned to produce a uniform heat distribution over the surface of the gas cylinder 12. The illustrated lower and upper heating elements 22 are adapted to produce different temperatures at the lower and upper portions of the gas cylinder 12 in order to obtain a substantially uniform heat distribution over the gas cylinder 12. In the illustrated embodiment, the lower heating elements 22*a*, 22*b* are preferably formed to collectively produce a higher temperature than the upper heating element 22*c* so that more heat (watts) is produced at the lower area of the gas cylinder warmer 10 than the upper area of the gas cylinder warmer 10. In this manner, more heat is applied to the bottom portion of the gas cylinder 12 than is applied to the top portion of the gas cylinder 12. For example, the illustrated gas cylinder warmer 10 has the lower heating elements 22*a*, 22*b* sized to collectively obtain a temperature in the range of about 90 degrees Fahrenheit to about 130 degrees Fahrenheit and the upper heating element 22*c* is sized to obtain a temperature in the range of about 80 degrees Fahrenheit to about 120 degrees Fahrenheit when ambient temperature is within the range of about 30 degrees Fahrenheit to about 95 degrees Fahrenheit. It has been found that a substantially uniform temperature profile is obtained in this manner for the gas cylinder 12. It is noted that the heating elements can alternatively be configured to obtain other temperatures for other specific applications and/or can alternatively be configured to obtain the same temperatures for other specific applications.

In the illustrated embodiment, the lower heating elements 22*a*, 22*b* produce a higher temperature than the upper heating element 22*c* by having a higher watt density (watts/area). The illustrated heating cable 30 produces a constant quantity of heat per unit length (watts/unit length) for each of the heating elements 22 but a higher watt density (watts/unit area) is created for the lower heating elements 22*a*, 22*b* by providing more length of the heating cable 30 per unit area than is provided in the upper heating element 22*c*.

Figure 6:
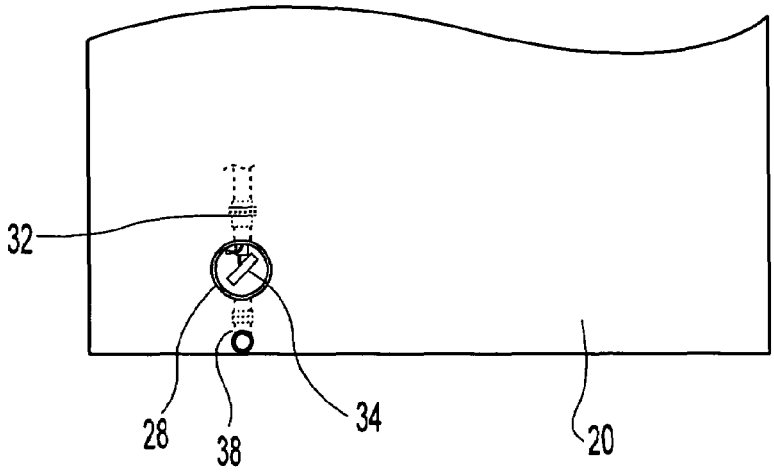
FIG. 6 is a reduced, fragmented elevational view similar to FIG. 5 but with an outer layer positioned over the inner layer.

The facing 20 is positioned over the outer surface of the liner 18 so that the pockets 26 and the heating elements 22 are located between the liner 18 and the facing 20 (best shown in FIG. 6). The illustrated facing 20 is formed by a rectangular-shaped sheet of generally flexible material. Preferably, the liner 18, the facing 20, and the pockets 26 are formed of the same material but alternatively different suitable materials can be utilized. The illustrated liner, facing, and pockets 18, 20, 26 are formed of silicone impregnated cloth. The illustrated liner and facing 18, 20 are secured together by sewing but alternatively can be secured together in any suitable manner such as, for example, bonding, clamping, fasteners or any other suitable method.

The illustrated insulation 24 is located between the liner 18 and the facing 20. The insulation 24 is preferably formed of a high-temperature, insulative material suitable for the temperature range of the particular application. The insulation 24 reduces the power needed to heat the gas cylinder 12 to the desired temperature by reducing heat lost through the facing 20. The illustrated insulation 24 is a sheet of fiberglass insulation preformed to fit the diameter of the gas cylinder 12 but any other suitable type of insulation can be utilized. The illustrated insulation 24 has a thickness of about two inches but any other suitable thickness can alternatively be utilized.

The first and second ends of the illustrated heating cable 30 extend through a conduit union 32 into the sealed conduit enclosure 28 to a suitable terminal block 34. Therefore, both the lead and dead ends of the heating cable 30 are sealed within the conduit enclosure 28. A suitable conduit union 32 is part number UNY75NR available from Appleton, Inc. of Rosemont, Ill. A suitable conduit enclosure 28 is part number GRC75A available from Appleton, Inc. of Rosemont, Ill. A suitable terminal block 34 is part number GRTB6-12 available from Appleton, Inc. of Rosemont, Ill. Ends of the heating cable 30 are preferably covered with shrink tube to provide a gas-tight barrier and are preferably connected to the terminal block 34 with Teflon insulated wire. Suitable Teflon insulated wire is part number UL 1180 available from Magnum Cable, Inc., of Solon, Ohio. A power input cable 36 is suitably connected to the terminal block 34 and extends through an elbow fitting 38 located at the bottom of the conduit enclosure 28 to the exterior side of the main wall 18. A suitable elbow fitting 38 is part number UNL75-50N available from Appleton, Inc. of Rosemont, Ill. A suitable power input cable 36 is a Teck Cable part number 27841 available from Belden Wire & Cable Co., Electronics Division, of Richmond, Ind. which contains three 14 AWG conductors with an aluminum armor and an outer PVC jacket. A metal clad cable connector 40 is preferably used to connect the power input cable 36 to the conduit enclosure 28. A suitable metal clad cable connector 40 is part number TMCX8875 available from Appleton, Inc., of Rosemont, Ill. The terminal block 34 is secured to the bottom of the conduit enclosure 28 and operatively connects the power input cable 36 to the heating cable 30. The conduit enclosure 28 preferably extends through openings in the insulation 24 and the facing 20 so that a covered access port 42 can be utilized to selectively provide access to the terminal block 34 therein. The elbow fitting 38 extends through an opening in the insulation 24 and the facing 20 to the exterior of the gas cylinder warmer so that the power input cable 36 is located in the exterior space surrounding the gas cylinder warmer 10. Preferably, epoxy is used to seal any gaps that appear between the power input cable 36 and the cable connector 40 and between the heating cable 30 and the conduit union 32 to provide a gas-tight seal at each location. Suitable epoxy is part number TSC1 available from Appleton, Inc., of Rosemont, Ill. Preferably, polyurethane foam 43 or other suitable material is used to fill gaps between the conduit enclosure 28 and the insulation 24 to provide the conduit enclosure 28 with rigid support. Suitable foam is Handi-Foam available from Fomo Products, Inc., of Norton, Ohio. Formed in this manner, the electrical components are sealed or environmentally contained within a gas-tight environment so that the gas cylinder warmer 10 can be utilized in outdoor and/or hazardous environments.

The illustrated top wall 16 includes a flexible first or inner layer or liner 44, a flexible second or outer layer or facing 46, and insulation 48 located between the liner 44 and the facing 46. The liner, facing and insulation 44, 46, 48 are preferably formed of the same materials as the similar components of the main wall 14 but alternatively can be any other suitable materials. The illustrated insulation 48 is a one-half inch thick fiberglass mat. The illustrated liner and facing 44, 46 are secured together by sewing but any other suitable means of connection can be alternatively utilized. The illustrated top wall 16 is provided with a central opening 50 which is sized and shaped for close passage of a regulator 52 of the gas cylinder 12. The illustrated top wall 16 also includes a pair of opposed slits 54 radially extending from the opening 50 to the sides of the top wall 16 for passage of the regulator 52 to the opening 50.

The top wall 16 is secured to the top of the main wall 14 to generally close the top of the cylinder formed by the main wall 14. The top wall 16 is positioned so that one of the slits 54 is positioned at the side edges or "opening" of the main wall 14. The illustrated top wall 16 and the illustrated main wall 14 are secured together by sewing but any other suitable means of connection can be alternatively utilized.

The illustrated main wall 14 is provided releasable mechanical fasteners 56 in the form of hook and loop fasteners along the side edges so that the main wall 14 can be releasably secured about the gas cylinder 12. The hook and loop fastener 56 can be of any suitable type such as, for example, VELCRO. It is noted that any other suitable fastening device can alternatively be utilized to releasably secure the gas cylinder warmer 10 to the gas cylinder 12 such as, for example, belts, buckles, buttons, fasteners, or any other suitable device.

Figure 8D:
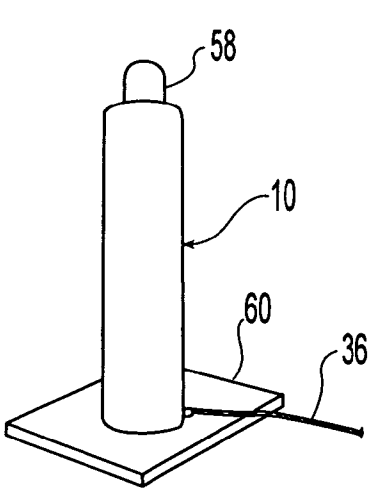
FIG. 8A to 8D are elevational views showing installation of the gas cylinder warmer of FIGS. 1 to 7 onto a gas cylinder.
Figure 8C:
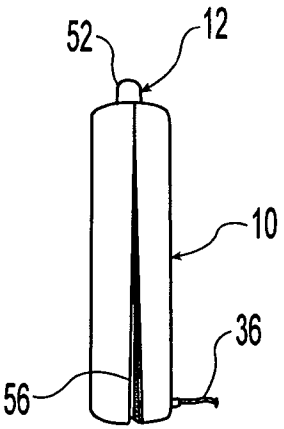
Figure 8B:
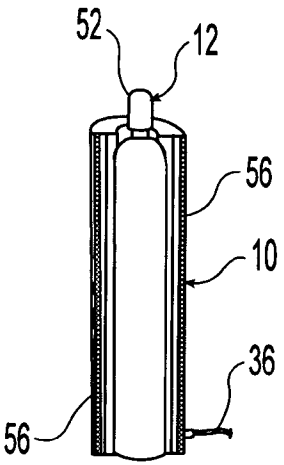
Figure 8A:
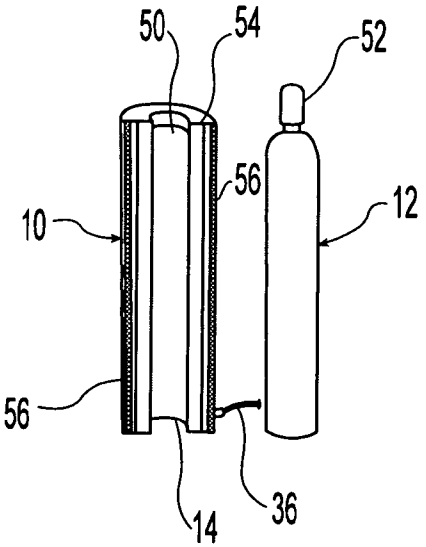

To install the gas cylinder warmer 10 onto the gas cylinder 12, the hook and loop fastener 56 is released so that the side edges of the main wall 14 are open as best shown in FIG. 8A. Opened in this manner, the main wall 14 can be placed onto the outer surface of the gas cylinder 12 with the liner 18 directly contacting the outer surface of the gas cylinder 12 and the regulator 52 of the gas cylinder 12 passing through the opening 50 in the top wall 16 as best shown in FIG. 8B. It is noted that during installation the regulator 52 can pass to the opening 50 through the slit 54. The hook-and-loop fasteners 56 are then connected to secure the edges of the main wall 14 about the periphery of the gas cylinder 12 as best shown in FIG. 8C. Once installed, an insulated cap 58 is preferably located onto the regulator 52 of the gas cylinder 12 to reduce heat loss therethrough and the gas cylinder 12 is positioned onto a thermally insulating mat 60 to reduce thermal loss through the bottom of the gas cylinder 12 as best shown in FIG. 8D. The power input cable 36 is connected to a suitable power source and voltage is supplied to the heating elements 22 so that the heating elements 22 produce heat which transfers from the heating elements 22 to the gas cylinder 12 through the liner 18.

From the foregoing disclosure and detailed description of certain preferred embodiments, it should be appreciated that the present invention provides a gas cylinder warmer 10 which provides a substantially uniform temperature over the gas cylinder 12. The gas cylinder warmer 10 can also be used outdoors and/or in hazardous locations (Class I, Division I, and Group C &D). It should be appreciated that a thermostat and/or temperature controller is not required to regulate the temperature of the heating elements 22 because they are self regulating.

From the foregoing disclosure and detailed description of certain preferred embodiments, it is also apparent that various modifications, additions and other alternative embodiments are possible without departing from the true scope and spirit of the present invention. The embodiments discussed were chosen and described to provide the best illustration of the principles of the present invention and its practical application to thereby enable one of ordinary skill in the art to utilize the invention in various embodiments and with various modifications as are suited to the particular use contemplated. All such modifications and variations are within the scope of the present invention as determined by the appended claims when interpreted in accordance with the benefit to which they are fairly, legally, and equitably entitled.

What is claimed is:

1. A gas cylinder warmer comprising, in combination:

first and second layers;

a plurality of electric, self-regulating heating elements positioned between the first and second layers;

wherein a first one of the heating elements produces a higher temperature than a second one of the heating elements;

wherein the heating elements are formed by a self-regulating heating cable; and wherein the self-regulating heating cable forms a higher watt density at the first one of the heating elements than at the second one of the heating elements.

2. The gas cylinder warmer according to claim 1, wherein the first one of the heating elements is located below the second one of the heating elements.

3. The gas cylinder warmer according to claim 1, wherein the first and second layers are formed of silicone impregnated cloth.

4. The gas cylinder warmer according to claim 1, further comprising insulation located between the heating elements and the second layer.

5. The gas cylinder warmer according to claim 1, wherein the first and second layers form a cylindrically-shaped main wall and further comprising a top wall located at the top of the main wall.

6. The gas cylinder warmer according to claim 3, wherein the top wall is provided with an opening for passage of a gas cylinder regulator therethrough.

7. A gas cylinder warmer comprising, in combination:

first and second layers;

a plurality of electric, self-regulating heating elements positioned between the first and second layers;

wherein a first one of the heating elements produces a higher temperature than a second one of the heating elements; and wherein the first layer is provided with a plurality of pockets and the heating elements are located within the pockets.

8. A gas cylinder warmer comprising, in combination:

first and second layers;

a plurality of electric, self-regulating heating elements positioned between the first and second layers;

wherein a first one of the heating elements produces a higher temperature than a second one of the heating elements; and a gas-tight enclosure containing an electrical connection between a power input cable and the heating elements.

9. A gas cylinder warmer comprising, in combination:

a cylindrically-shaped main wall including a liner, a facing and insulation located between the liner and the facing;

at least one electric, self-regulating heating element positioned between the liner and the insulation; and a planar top wall located at the top of the main wall and having an opening for passage of a gas cylinder regulator.

10. The gas cylinder warmer according to claim 9, wherein there is a first heating element and a second heating element and the first heating element produces a higher temperature than the second heating element.

11. The gas cylinder warmer according to claim 10, wherein the first heating element is located below the second heating element.

12. The gas cylinder warmer according to claim 9, wherein the heating element is formed by a self-regulating heating cable.

13. The gas cylinder warmer according to claim 12, wherein the self-regulating heating cable forms a higher watt density at the first heating element than at the second heating element.

14. The gas cylinder warmer according to claim 9, wherein the liner and the facing are formed of silicone impregnated cloth.

15. The gas cylinder warmer according to claim 9, wherein the liner is provided with a pocket and the heating element is located within the pocket.

16. The gas cylinder warmer according to claim 9, further a gas-tight enclosure containing an electrical connection between a power input cable and the heating element.

17. A gas cylinder warmer comprising, in combination:

a cylindrically-shaped main wall including a liner, a facing, and insulation located between the liner and the facing;

first and second electric, self-regulating heating elements positioned between the liner and the insulation;

wherein the liner is provided with first and second pockets and the first and second heating elements are located within the pockets;

wherein the first heating element has a higher wattage density than the second heating element;

wherein the first heating element is located below the second heating element;

a gas-tight enclosure containing an electrical connection between a power input cable and the first and second heating elements; and a planar top wall located at the top of the main wall and having an opening for passage of a gas cylinder regulator.

18. The gas cylinder warmer according to claim 17, wherein the first and second heating elements are formed by a self-regulating heating cable and the self-regulating heating cable forms a higher watt density at the first heating element than at the second heating element.

* * * * *